US009675511B1

(12) United States Patent
Wray et al.

(10) Patent No.: US 9,675,511 B1
(45) Date of Patent: Jun. 13, 2017

(54) BURIAL VAULT ASSEMBLY

(71) Applicants: Raymond Wray, Fort Jackson, SC (US); Beverly Roan-Moore, Raleigh, NC (US)

(72) Inventors: Raymond Wray, Fort Jackson, SC (US); Beverly Roan-Moore, Raleigh, NC (US)

( * ) Notice: Subject to any disclaimer, the term of this patent is extended or adjusted under 35 U.S.C. 154(b) by 0 days.

(21) Appl. No.: 15/225,531

(22) Filed: Aug. 1, 2016

(51) Int. Cl.
*A61G 17/00* (2006.01)
*B25G 1/10* (2006.01)
*E04H 13/00* (2006.01)

(52) U.S. Cl.
CPC ..... *A61G 17/00* (2013.01); *B25G 1/102* (2013.01); *E04H 13/00* (2013.01)

(58) Field of Classification Search
CPC .. A61G 17/00; A61G 2017/041; A61G 17/02; A61G 17/041; E04H 13/00; B26G 1/102
USPC ..... 27/35, 14, 17; 52/128, 139, 140, 141
See application file for complete search history.

(56) References Cited

U.S. PATENT DOCUMENTS 964,439 A 7/1910 Lerro
3,188,712 A 6/1965 Bauermeister
3,581,452 A * 6/1971 Jalbert ..... E04H 13/00 27/1
3,681,820 A * 8/1972 Jalbert ..... A61B 50/00 27/7
3,898,718 A 8/1975 Eubank
4,328,606 A * 5/1982 Nunes ..... A61G 17/00 27/35
4,893,385 A * 1/1990 Schrag ..... E04H 13/006 27/29
5,240,013 A 8/1993 Johnson et al.
D417,540 S 12/1999 Agee et al.
7,631,404 B2 * 12/2009 Scruggs ..... A61G 17/02 27/35
7,703,186 B1 * 4/2010 Williamson ..... A61G 17/02 27/17
8,214,979 B2 * 7/2012 Scruggs ..... A61G 17/02 27/35
2002/0144383 A1 10/2002 Spence
2012/0000044 A1 * 1/2012 Scruggs ..... A61G 17/02 27/2

FOREIGN PATENT DOCUMENTS

EP 0985399 9/1999
GB 1477582 A * 6/1977 ..... A61G 17/00

* cited by examiner

*Primary Examiner* — William Miller

(57) ABSTRACT

A burial vault assembly includes a box that may contain a corpse. The box may be buried underground having the corpse being vertically oriented. Thus, the box occupies less space in a graveyard than a casket. A lid is selectively positioned on the box and the lid closes the box. A seal is coupled to the lid and the seal is comprised of a resiliently compressible material. Thus, the seal forms a fluid impermeable seal with the box when the lid is positioned on the box to inhibit decomposition gases from escaping the box.

6 Claims, 4 Drawing Sheets

BURIAL VAULT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98.

The disclosure and prior art relates to vault devices and more particularly pertains to a new vault device for facilitating a corpse to be buried in a vertical orientation.

BRIEF SUMMARY OF THE INVENTION

An embodiment of the disclosure meets the needs presented above by generally comprising a box that may contain a corpse. The box may be buried underground having the corpse being vertically oriented. Thus, the box occupies less space in a graveyard than a casket. A lid is selectively positioned on the box and the lid closes the box. A seal is coupled to the lid and the seal is comprised of a resiliently compressible material. Thus, the seal forms a fluid impermeable seal with the box when the lid is positioned on the box to inhibit decomposition gases from escaping the box.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
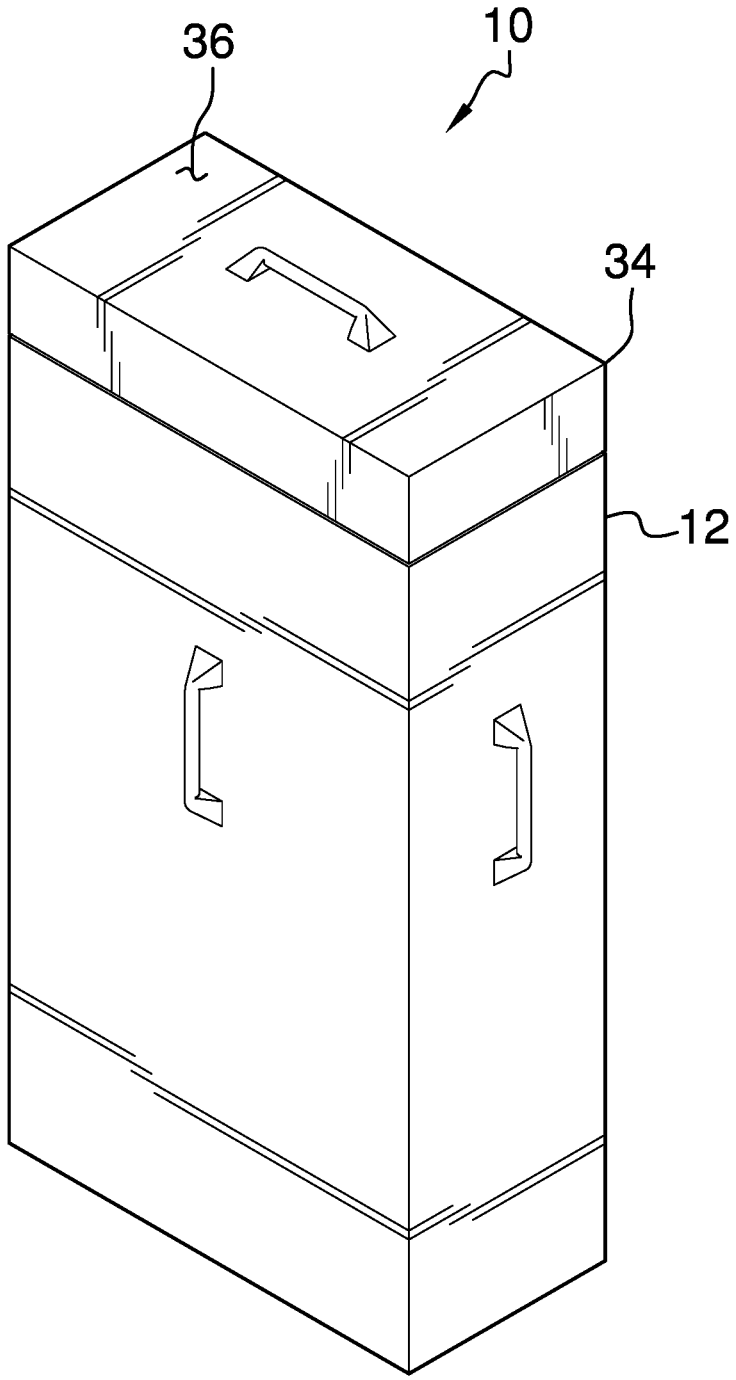
FIG. 1 is a perspective view of a burial vault assembly according to an embodiment of the disclosure.
Figure 2:
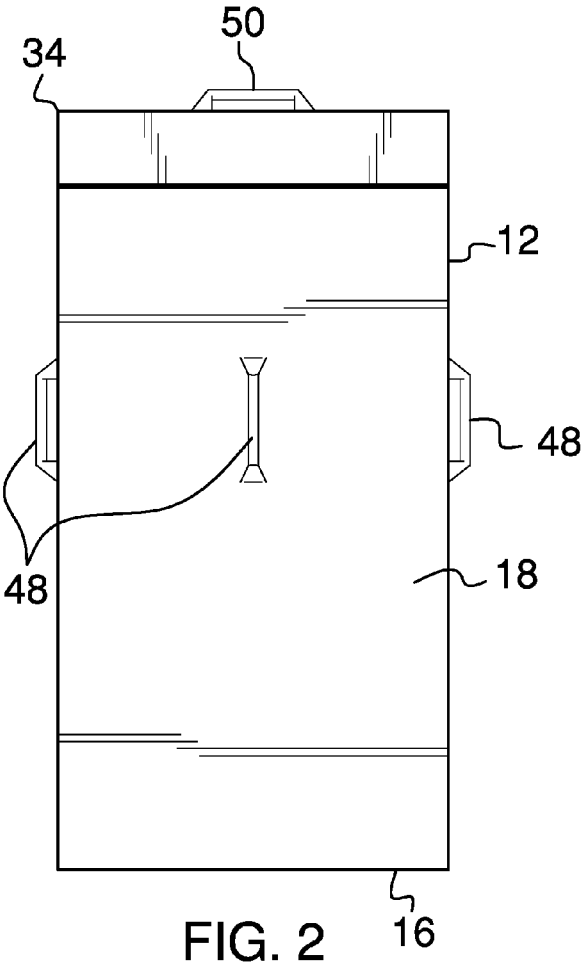
FIG. 2 is a back view of an embodiment of the disclosure.
Figure 3:
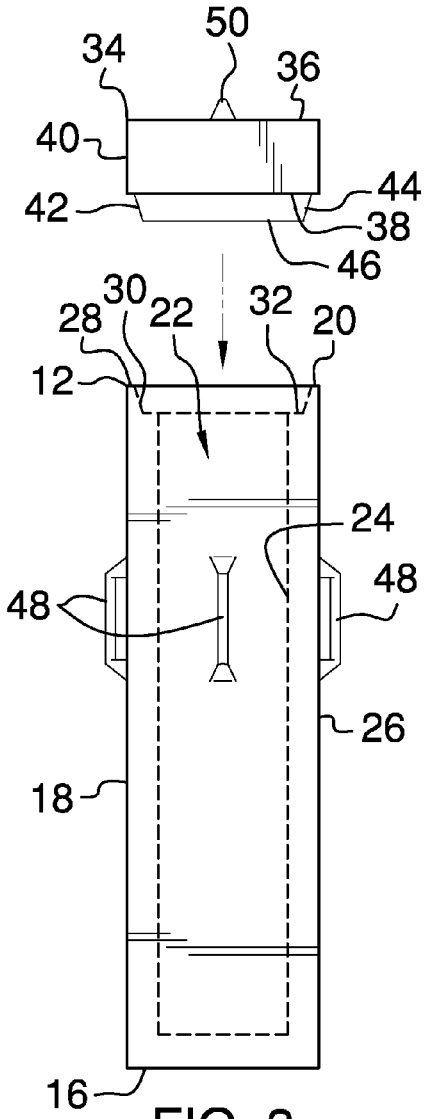
FIG. 3 is a right side view of an embodiment of the disclosure.
Figure 4:
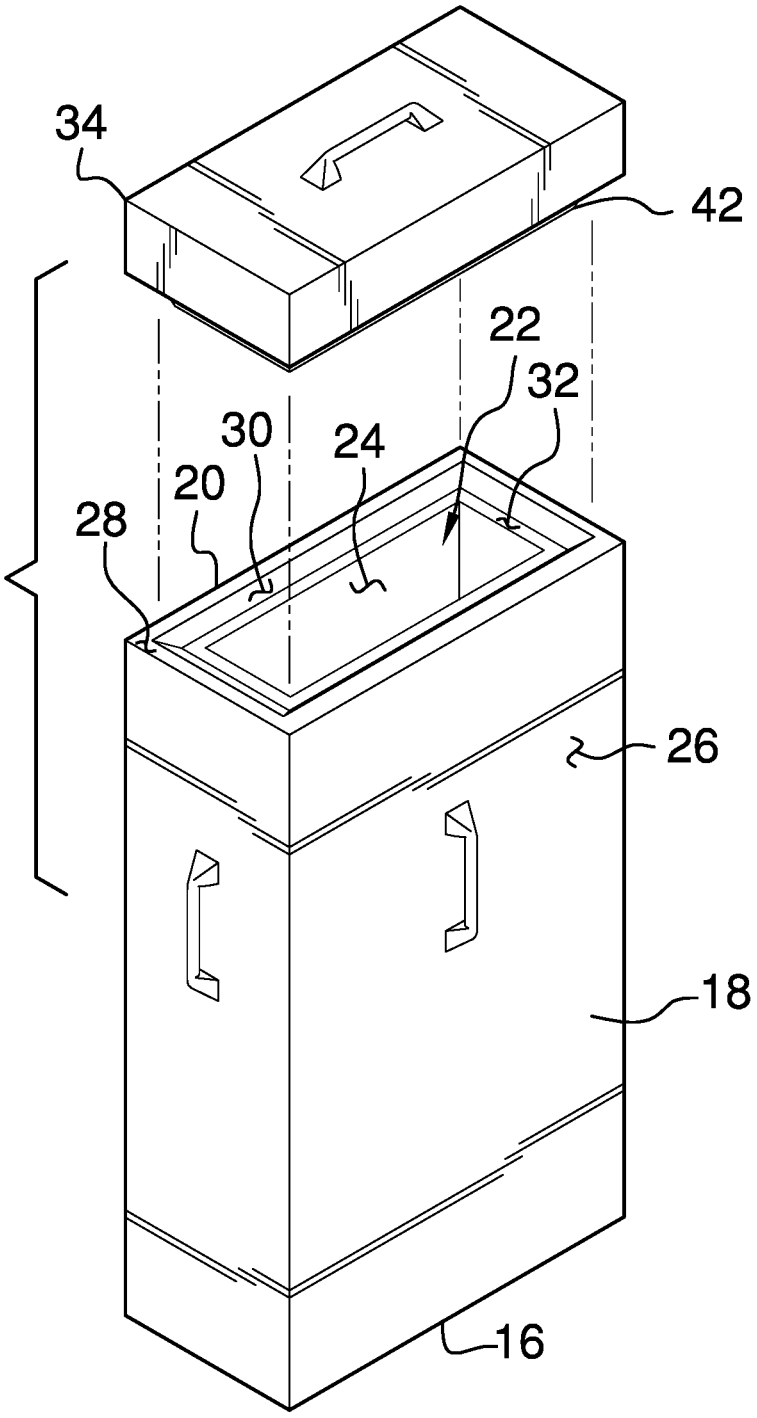
FIG. 4 is an exploded perspective view of an embodiment of the disclosure.
Figure 5:
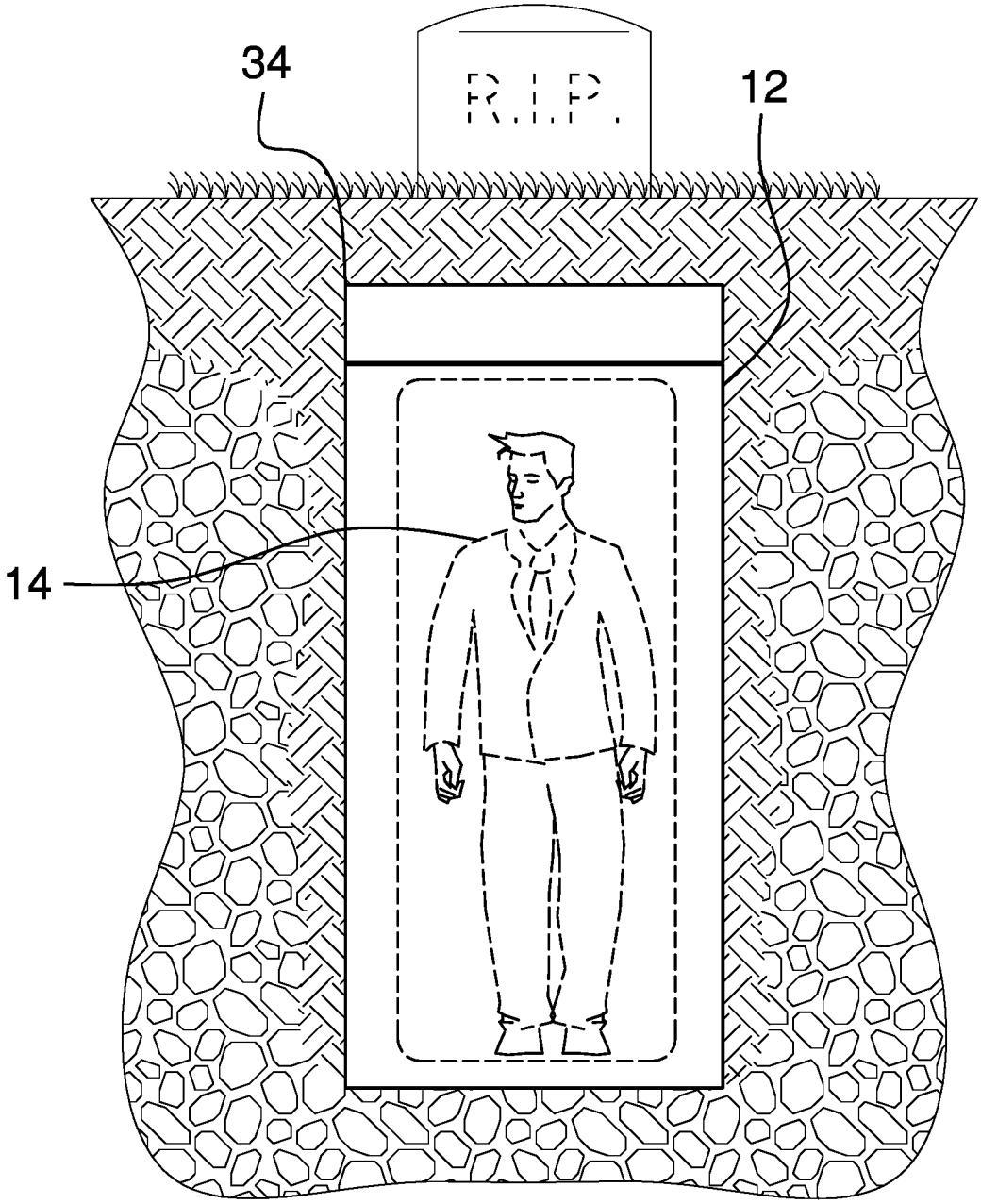
FIG. 5 is a perspective in-use view of an embodiment of the disclosure.

With reference now to the drawings, and in particular to FIGS. 1 through 5 thereof, a new vault device embodying the principles and concepts of an embodiment of the disclosure and generally designated by the reference numeral 10 will be described.

As best illustrated in FIGS. 1 through 5, the burial vault assembly 10 generally comprises a box 12 that may contain a corpse 14. The box 12 is buried underground having the corpse 14 being vertically oriented. Thus, the box 12 occupies less horizontal space in a graveyard than a casket. The box 12 is comprised of a fluid impermeable material.

The box 12 has a bottom wall 16 and an outer wall 18 extending upwardly therefrom. The outer wall 18 has a distal edge 20 with respect to the bottom wall 16. The distal edge 20 defines an opening 22 into the box 12. The corpse 14 is inserted through the opening 22 into the box 12.

The outer wall 18 has an inner surface 24 and an outer surface 26. The distal edge 20 has a first surface 28, a second surface 30 and a third surface 32. The first surface 28 extends inwardly from the outer surface 26 of the outer wall 18. The third surface 32 extends outwardly from the inner surface 24 of the outer wall 18. The second surface 30 angling downwardly between the first surface 28 and the third surface 32. The first surface 28 is oriented to be parallel with respect to the third surface 32.

A lid 34 is provided and the lid 34 is selectively positioned on the box 12 such that the lid 34 closes the box 12. The lid 34 has a top surface 36, a bottom surface 38 and a peripheral edge 40 extending therebetween. The box 12 may have a length ranging between one meter and two meters and a width ranging between seventy five cm and one hundred cm. The lid 34 may have corresponding length and width with respect to the box 12.

A seal 42 is provided and the seal 42 is coupled to the lid 34. The seal 42 forms a fluid impermeable seal 42 with the box 12 when the lid 34 is positioned on the box 12. Thus, the seal 42 inhibits decomposition gases from escaping the box 12. The seal 42 is positioned on the bottom surface 38 of the lid 34.

The seal 42 is inset with respect to the peripheral edge 40 of the lid 34. The seal 42 has an outermost surface 44 and a distal surface 46 with respect to the lid 34. The outermost surface 44 angles inwardly between the bottom surface 38 of the lid 34 and the distal surface 46. The bottom surface 38 of the lid 34 abuts the first surface 28 of the box 12 when the lid 34 is positioned on the box 12. The outermost surface 44 of the seal 42 abuts the second surface 30 of the box 12. The distal surface 46 of the seal 42 abuts the third surface 32 of the box 12. The seal 42 may be comprised of a resiliently compressible material.

A plurality of handles 48 is provided. Each of the handles 48 is coupled to the box 12 and each of the handles 48 may be grip 50*ped*. The handles 48 are spaced apart from each other and are distributed around the outer wall 18 of the box 12. A grip 50 is coupled to the top surface 36 of the lid 34 and the grip 50 may be grip 50*ped*.

In use, the corpse 14 is positioned within the box 12 having the corpse 14 extending between the bottom wall 16 of the box 12 and the opening 22 in the box 12. The lid 34 is positioned on the box 12. The seal 42 engages the box 12 to form a fluid impermeable seal 42 with the box 12. The box 12 is lowered into a hole in ground. The box 12 is vertically oriented in the hole. Thus, the box 12 occupies less horizontal space in a graveyard with respect to a coffin. Moreover, the vertical orientation of the box 12 inhibits grave robbing.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A burial vault assembly being configured to vertically orient a corpse underground, said assembly comprising:

a box being configured to contain the corpse, said box being configured to be buried underground having the corpse being vertically oriented thereby facilitating said box to occupy less space in a graveyard than a casket, said box has a bottom wall and an outer wall extending upwardly therefrom, said outer wall having a distal edge with respect to said bottom wall, said distal edge defining an opening into said box, said outer wall having an inner surface and an outer surface, said distal edge having a first surface, a second surface and a third surface, said first surface extending inwardly from said outer surface of said outer wall, said third surface extending outwardly from said inner surface of said outer wall, said second surface angling downwardly between said first surface and said third surface;

a lid being selectively positioned on said box such that said lid closes said box; and a seal being coupled to said lid, said seal being comprised of a resiliently compressible material such that said seal forms a fluid impermeable seal with said box when said lid is positioned on said box wherein said seal is configured to inhibit decomposition gases from escaping said box.

2. The assembly according to claim 1, wherein:

said lid has a top surface, a bottom surface and a peripheral edge extending therebetween;

said seal being positioned on said bottom surface of said lid, said seal being inset with respect to said peripheral edge of said lid, said seal having an outermost surface and a distal surface with respect to said lid.

3. A burial vault assembly being configured to vertically orient a corpse underground, said assembly comprising:

a box being configured to contain the corpse, said box being configured to be buried underground having the corpse being vertically oriented thereby facilitating said box to occupy less space in a graveyard than a casket;

a lid being selectively positioned on said box such that said lid closes said box;

a seal being coupled to said lid, said seal being comprised of a resiliently compressible material such that said seal forms a fluid impermeable seal with said box when said lid is positioned on said box wherein said seal is configured to inhibit decomposition gases from escaping said box;

said lid having a top surface, a bottom surface and a peripheral edge extending therebetween;

said seal being positioned on said bottom surface of said lid, said seal being inset with respect to said peripheral edge of said lid, said seal having an outermost surface and a distal surface with respect to said lid;

said box has a distal edge, said distal edge having a first surface, a second surface and a third surface; and said outermost surface angling inwardly between said bottom surface of said lid and said distal surface, said bottom surface of said lid abutting said first surface of said box when said lid is positioned on said box, said outermost surface of said seal abutting said second surface of said box, said distal surface of said seal abutting said third surface of said box.

4. The assembly according to claim 1, further comprising a plurality of handles, each of said handles being coupled to said box wherein each of said handles is configured to be gripped, said handles being spaced apart from each other and being distributed around said outer wall of said box.

5. The assembly according to claim 2, further comprising a grip being coupled to said top surface of said lid wherein said grip is configured to be gripped.

6. A burial vault assembly being configured to vertically orient a corpse underground, said assembly comprising:

a box being configured to contain the corpse, said box being configured to be buried underground having the corpse being vertically oriented thereby facilitating said box to occupy less space in a graveyard than a casket, said box having a bottom wall and an outer wall extending upwardly therefrom, said outer wall having a distal edge with respect to said bottom wall, said distal edge defining an opening into said box, said outer wall having an inner surface and an outer surface, said distal edge having a first surface, a second surface and a third surface, said first surface extending inwardly from said outer surface of said outer wall, said third surface extending outwardly from said inner surface of said outer wall, said second surface angling downwardly between said first surface and said third surface;

a lid being selectively positioned on said box such that said lid closes said box, said lid having a top surface, a bottom surface and a peripheral edge extending therebetween;

a seal being coupled to said lid, said seal forming a fluid impermeable seal with said box when said lid is positioned on said box wherein said seal is configured to inhibit decomposition gases from escaping said box, said seal being positioned on said bottom surface of said lid, said seal being inset with respect to said peripheral edge of said lid, said seal having an outermost surface and a distal surface with respect to said lid, said outermost surface angling inwardly between said bottom surface of said lid and said distal surface, said bottom surface of said lid abutting said first surface of said box when said lid is positioned on said box, said outermost surface of said seal abutting said second surface of said box, said distal surface of said seal abutting said third surface of said box, said seal being comprised of a resiliently compressible material;

a plurality of handles, each of said handles being coupled to said box wherein each of said handles is configured to be gripped, said handles being spaced apart from each other and being distributed around said outer wall of said box; and a grip being coupled to said top surface of said lid wherein said grip is configured to be gripped.

* * * * *